United States Patent [19]

Kiejzik

[11] 4,040,317

[45] Aug. 9, 1977

[54] FILM TRIMMING DEVICE

[76] Inventor: Paul A. Kiejzik, Motion Technology Corp., Mount Pleasant Drive, Aston, Pa. 19014

[21] Appl. No.: 725,277

[22] Filed: Sept. 21, 1976

[51] Int. Cl.[2] ..... B26D 3/12

[52] U.S. Cl. ..... 83/56; 83/425; 83/425.2; 83/434; 242/56.2

[58] Field of Search ..... 83/56, 425, 425.2, 425.3, 83/425.4, 434; 242/56.3, 56.2, 56.8

[56] References Cited

U.S. PATENT DOCUMENTS

| | | | |
|---|---|---|---|
| 1,602,746 | 10/1926 | Bowen | 83/434 |
| 2,678,693 | 5/1954 | Kusiv | 83/434 |
| 2,822,046 | 2/1958 | Krueger | 83/425 |

*Primary Examiner*—Donald R. Schran

[57] ABSTRACT

A film trimming device places opposing wheel rollers on spaced-apart axes of rotation on respective separate shafts therefor, with radially outward circumscribing faces thereof in contact and moving in a common direction at the point of contact, with a blade's cutting edge directed in a direction substantially opposite to that common direction and pressed against correspondlateral side faces of the contacting rollers at the point of contact of the rollers, with tape guiding and channeling structures shaped and positioned to regulate adjustably the amount of tape margin extending beyond the lateral side faces of the rollers when guided onto the radially outward circumscribing face of one of the rollers before reaching the cutting edge and for channeling the trimmed tape to a take-off point, the blade being normally biased into the cutting position and being retractable therefrom for permitting first drawing a portion of fed tape to and beyond the cutting point before gradually returning the cutting edge to press against the edge of the tape being drawn past, such that the cutting edge initially slices into the edge of the margin and upon the cutting edge reaching its position against the lateral side faces at which point the cutting edge trims the margin portion extending beyond the lateral side faces, at least one of the rollers being free-floating laterally to and fro along its axis of rotation, and there being an anti-bias structure pressing on the opposite lateral side face of the free-floating roller in order to hold it in a contacting relationship with the cutting edge.

12 Claims, 7 Drawing Figures

FILM TRIMMING DEVICE

This invention relates to a film edge-trimming device for converting from a wider to narrower film.

BACKGROUND OF THE INVENTION

Prior to the present invention, devices for trimming a margin from a film along the length thereof to reduce the width thereof thereby, consisted of opposing cutting wheels of which each had a cutting edge with their respective cutting edges contacting each other with the wheels being mounted in overlapping relationships such that a tape or film fed along a circumscribing wheel outer-surface of one of the wheel became pinched and severed at the point of wheels-overlapping and cutting by the respective blades simultaneously, to sever the marginal width of film or tape carried by the film-mounting one of the wheels. Such severing when the apparatus was new worked well, but in order to operate neatly and efficiently, the opposing wheels and thereby the opposing cutting edges were required to be pressed against one-another firmly in order to cut at the pinch point, and such constant and necessary pressure resulted in a wearing of the respective cutting edges of the wheels as well as a wearing of the bearing mountings thereof to result in a rapid deterioration of effective and accurate cutting. Such required therefor frequent replacement and maintenance of parts. Also, accuracy or precision in trimming an exact and continually consistant predetermined width of margin was lacking with the prior devices.

BROAD DESCRIPTION OF THE INVENTION

Accordingly, objects of the invention include the overcoming and/or avoiding of one or more difficulties and problems and short-comings of the prior trimming devices of the types typically discussed above.

Another object is to obtain a novel film-edge trimming device operating on a different principle than heretofore.

Another object is to obtain a film-edge trimming device in which a cutting blade and cutting edge thereof do not alter materially associated wheels by wear and do not alter cutting efficiency associated with those wheels as wear occurs, and do necessitate any substantial maintenance and/or replacement of the wheels or rollers.

Another object is to obtain a novel trimming device for film margin, adjustable intermittently at will to different desired widths to be trimmed.

Another object is to obtain a novel trimming device utilizable for trimming margin(s) alternately and/or simultaneously from either or both sides (opposite margins) thereof adjustably as might be desired or required for a particular film or tape.

Another object is to obtain improved guiding and channeling structure for film to be and being trimmed along its longitudinal axis.

Another object is to obtain a novel method of trimming a predetermined width of margin from a film or tape along the longitudian/length axis of the film/tape.

Another object is to maintain a contacting relationship between a cutting edge and side-faces of film-drawing rollers.

Another object is to equate pressures against opposite side faces of the contacting rollers, resulting from a cutting blade biased against roller faces on one side and from anti-biasing structure biasing against opposite side faces, preferably adjustably.

Another object is to provide drive mechanism for effecting the drawing of film/tape between opposing rollers at and in contact with a cutting edge of a biased blade.

Other objects become apparent from the preceding and following disclosure.

One or more objects above-noted are obtained by the invention as typically illustrated herein and by accompanying drawings.

Broadly the invention may be described as a tape or film trimming device with wheels or wheel-like rollers, hereinafter referred to as rollers, in positions spaced-apart from one-another with the axes of rotation thereof substantially parallel for respective mounting shafts, and with the radially outward circumscribing surfaces thereof in contact with one-another, and both of the contacting rollers having at-least one lateral side face thereof alinged with the corresponding lateral side face of the other, with a blade's cutting edge pressing thereagainst and being retractable from the pressing position. The blade has its cutting edge directed in a direction substantially counter or opposite to a predetermined direction that a tape will be drawn between the contacting radially outward circumscribing surfaces and positioned at substantially a point of their contact with one-another. By any appropriate counter-biasing mechanism, the biased blade and cutting edge thereof are retractable in order to lift the cutting egde outwardly away-from contact with the side faces of the two rollers while the drawn tape becomes threaded past the cutting point; after a tape has been drawn past the cutting point, the counter-biasing pressure may be removed to thereby permit the blade and cutting edge thereof to return to a position at which the cutting edge is pressed against the side edge of a tape margin to be cut, and as the tape is drawn advancingly along, the cutting edge slices into the margin edge while the biasing pressure causes the cutting edge to slice to a position again of contact with the side faces of both rollers at which point the margin proceeds to be trimmed to the extent that the margin extends beyond the side faces of the rollers, as the rollers revolve to advance the tape against the cutting edge. It is to be understood that while the invention is primarily directed to the trimming of film margin, such may apply to any tape, and accordingly the word "tape" as used herein is intended to include photographic and/or movie and/or camera and/or tape-recorder film and tape and the like.

Preferably another mechanism, such as a roller having its radially outward circular circumscribing surface in a slotted stepped-shape such that by moving the slotted roller to and fro laterally intermittently in a desired direction and to a desired distance of movement, tape channeled within the stepped slot is guided by the radially-outwardly extending flanges thereof onto the first of the contacting rollers discussed above, onto at least and along a portion of that roller's radially outward circular circumscribing surface, into the drawing-position at which cutting takes place as the tape is pulled against the cutting edge of the blade described above. Thereafter, the remaining portion of the tape is channeled onto the second one of the above-described contacting rollers along a portion of its radially outward circular circumscribing surface, to a take-off point.

In a preferred embodiment, at least one of the first or second roller (contacting rollers) is/are free-floating along its/their axis/axes of rotation, pressure of the biased blade against the lateral side surface thereof holding the free-floating roller(s) in a stationary position against movement laterally toward the blade further, and there being an anti-bias mechanism such as either a biased anti-bias arm having a roller on the end thereof, or alternatively such as another blade (and cutting edge thereof), pressing against opposite lateral side(s) of the free-floating roller(s) whereby the free-floating roller(s) remain(s) centered substantially. In a further preferred embodiment, there is provided an equating mechanism whereby pressures on opposite lateral side faces of the respective contacting roller(s) is substantially the same, such as an interconnecting spring of preferably an adjustable nature for varying the spring pressures.

Also there preferably is a tape-guide structure which channels the tape from a feed position and/or from the slotted stepped roller onwardly to the cuttion point where the contacting rollers draw downwardly the tape against the cutting edge, and and which thereafter thereafter channels the trimmed tape to a take-off position.

Typical of variations possible, is one embodiment in which the solely first or second roller is free-floating, while in an embodiment as an alternate thereof, both the first and second wheels are floating as free-floating for movement to and fro laterally along rotational axes thereof; in such embodiment, preferably there would be a separate anti-bias lever and roller thereof for each separate lateral side face of the opposite (i.e. counter-bias) side of the first and second rollers.

While the terminology "contacting" rollers has been used with regard to the description of the first and second rollers (so-called) between which the tape is drawn at the location of the cutting edge, also the guiding mechanism of the slotted stepped-surface roller is also in contact with and thereby driven by the rotation of the first roller.

Preferably the manual and/or automated drive structure is mounted on the second wheel to thereby drive all other wheels (as might be desired) in contact directly or indirectly therewith. However, there may be individual interconnecting chain and/or belt and/or gear drive(s), or the like, as may be desired.

While illustrated, take-off wheel(s)/roller(s) and/or feed wheel(s)/roller(s) may be utilized optionally, as well as feed and/or take-up reels, all of which in a more preferred embodiment constitute a part of a greater combination of the present invention.

THE FIGURES

DETAILED DESCRIPTION OF THE INVENTION

In greater detail, FIGS. 1 through 5 and 6A illustrate a common preferred embodiment of the film trimmer of this invention, for trimming a predetermined width of margin therefrom.

Figure 1:
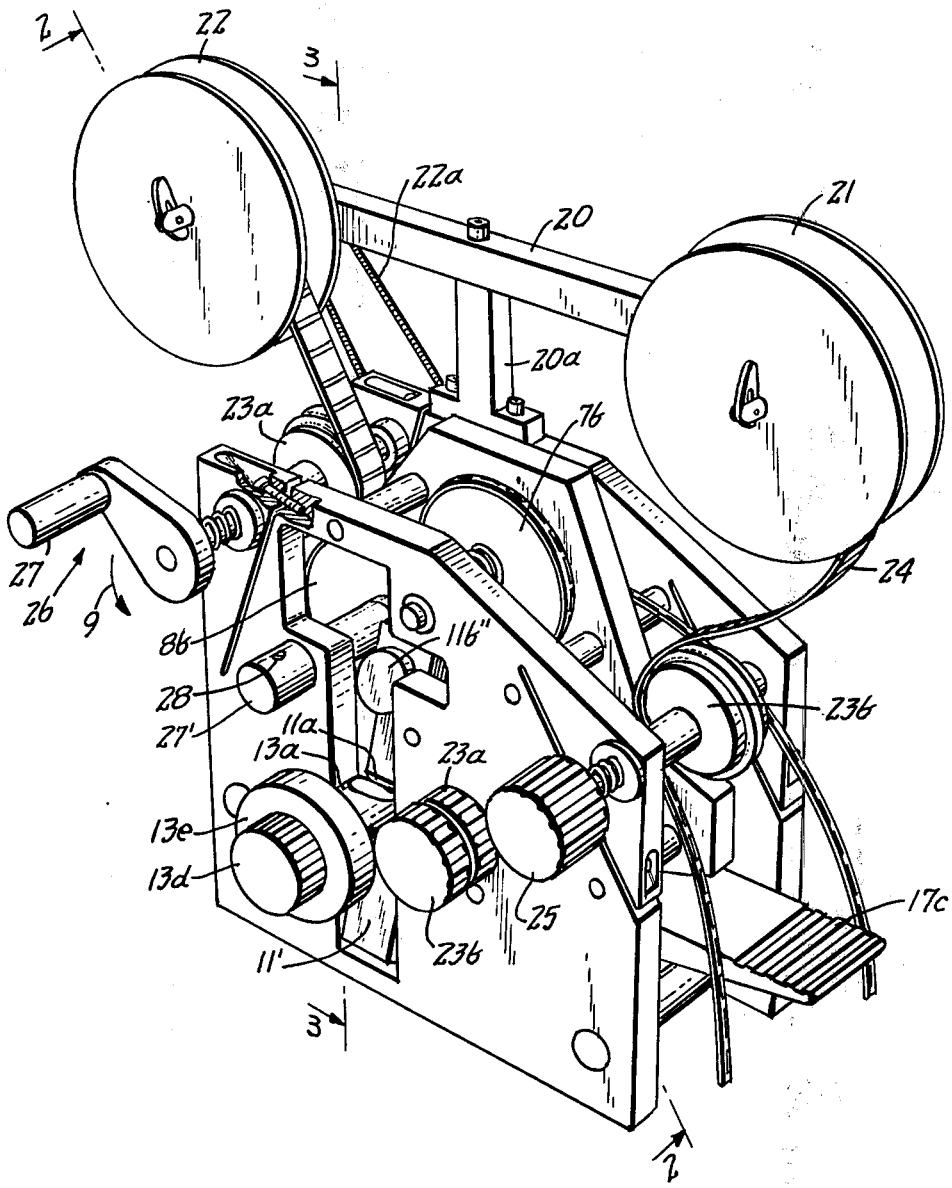
FIG. 1 illustrates a front-side perspective view of a preferred embodiment of the invention, having also cut-lines indicative of other Figures illustrated.
Figure 3:
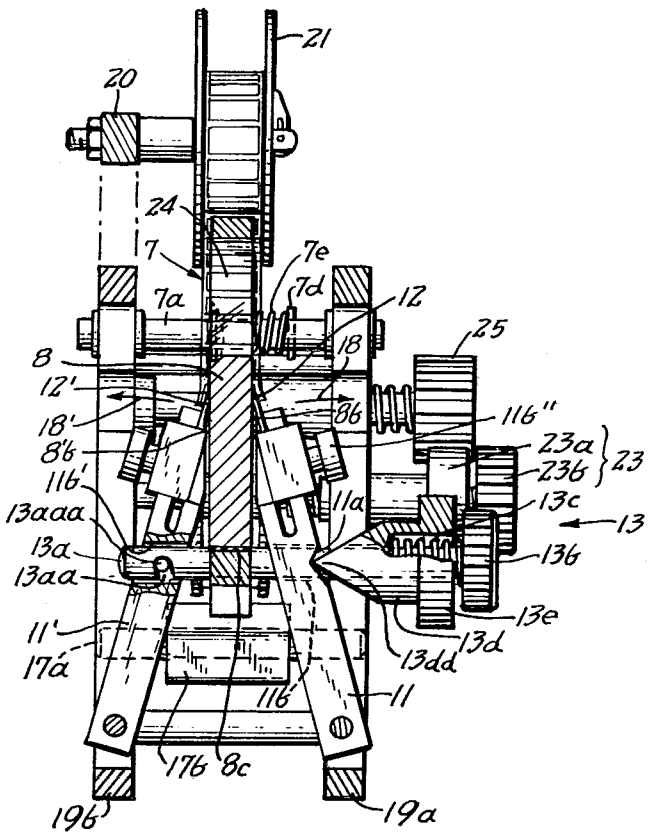
FIG. 3 illustrates an in-part cross-sectional view looking forwardly as taken along line 3—3 of each of FIGS. 1 and 2 of that embodiment.
Figure 2:
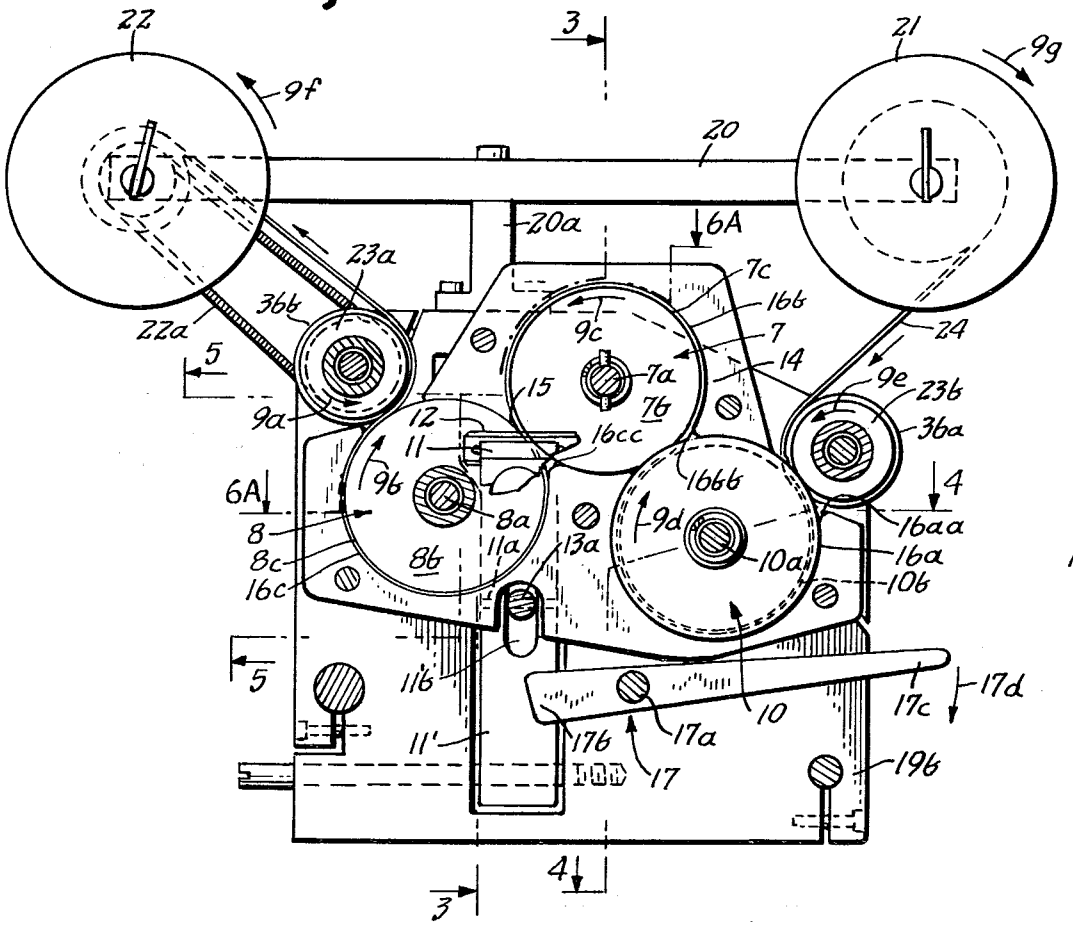
FIG. 2 illustrates a side in-part cut-away view of the embodiment of FIG. 1 as taken along line 2—2 of FIG. 1.
Figure 4:
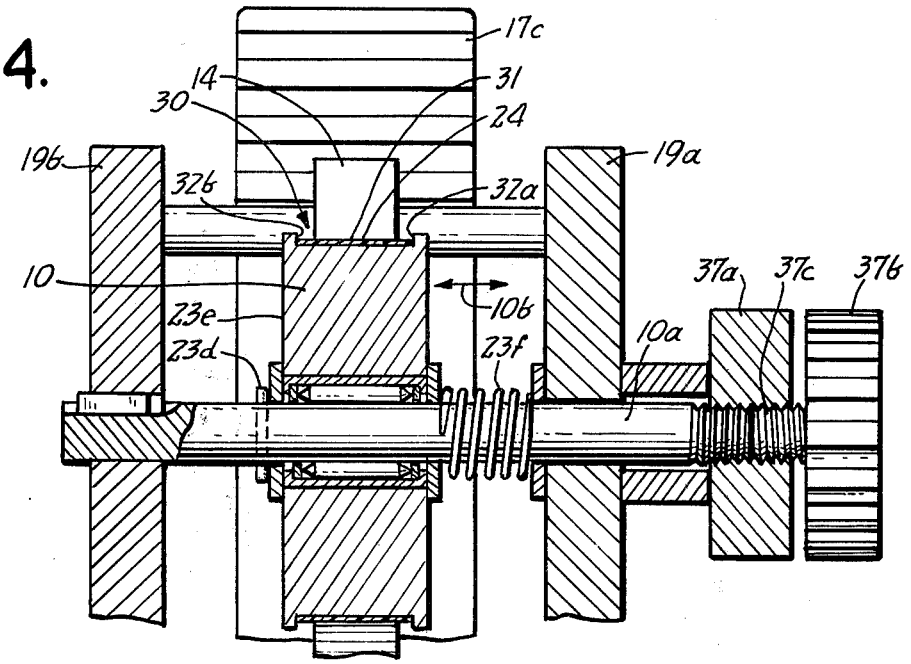
FIG. 4 illustrates an in-part cross-sectional view looking downwardly as taken along line 4—4 of FIG. 2.
Figure 5:
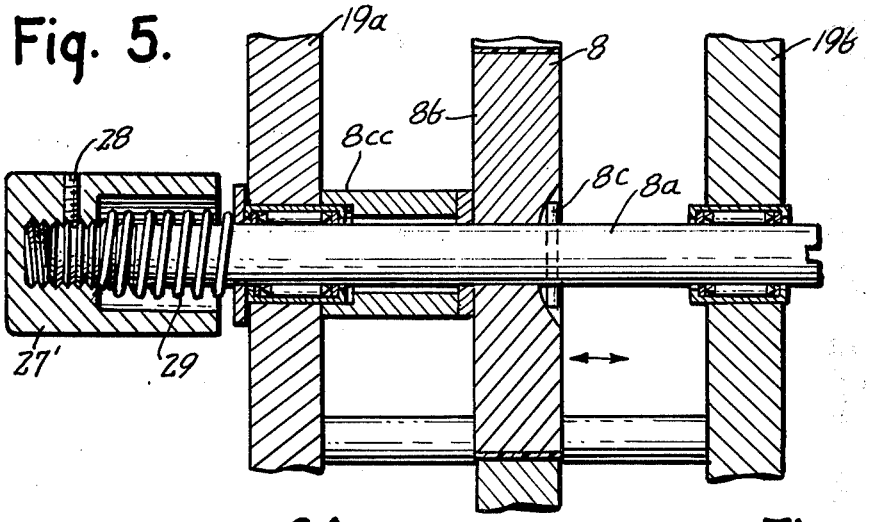
FIG. 5 illustrates an in-part cross-sectional view looking rearwardly as taken along line 5—5 of FIG. 2.

In particular, as viewed in the cut-away of FIG. 1, the rollers 8 and 7 have containing radially outward circumscribing surfaces 8*c* and 7*c* and lateral side faces 8*b* and 7*b*, and mounting shafts 8*a* and 7*a*, with the surfaces 8*c* and 7*c* coming into contact at point 15 as tape 24 is drawn downwardly therebetween thereby pressing downwardly a margin of the tape against cutting edge 12 of the blade cutting structure 11 having locking key 11*b*, with the cutting edge pressing (biased against) each of surfaces 8*b* and 7*b*. As crank 26 by handle 27 is cranked in direction 9, take-off roller 23*a* is thereby revolved in direction 9*a*, and by contact of roller 23*a* with roller 8, roller 8 revolves in direction 9*b*, and by contact between rollers 8 and 7, roller 7 revolves in direction 9*c*, and by contact between rollers 7 and 10, roller 10 revolves in direction 9*d*, and by contact between rollers 10 and 23*b* (feed roller 23*b*), feed roller 23*b* revolves in direction 9*e*, while reel (take-up reel) 22 revolves in direction 9*f*, and feed reel 21 revolves in direction 9*g*. Rubber or plastic or other equivanlent O-rings 36*a* on feed roller 23*b* and O-rings 36*b* on take-off roller 23*a* serve to enhance grasping of the tape for feed and take-off thereof respectively to the intermediate rollers.

Guide-structure 14 has tapered corner 16*aa* facilitating the correct direction of tape-feed from feed roller 23*b* surface into the channeling space 16*a*, and from the roller 10 having the stepped slot 10*b*, the tape 24 leaves and moves past tapered corner 16*bb* as it is feed into channeling space 16*b* onto roller 7, and then past tapered corner 16*cc* into channeling space 16*c* onward onto the take-off roller 23*a*.

Figure 6A:
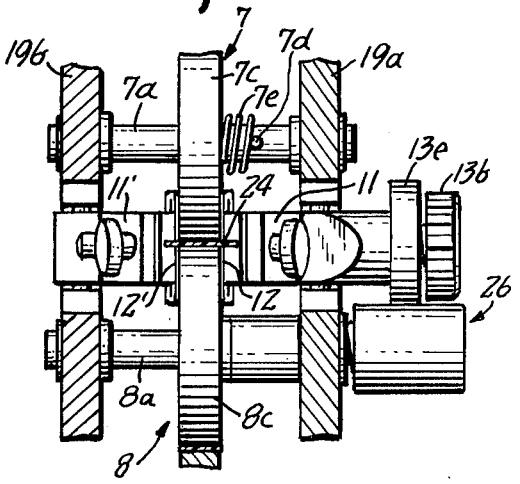
FIG. 6A illustrates a cut-away in-part view along line 6A—6A of FIG. 2, of tape-drawing rollers, looking downwardly.
Figure 6B:
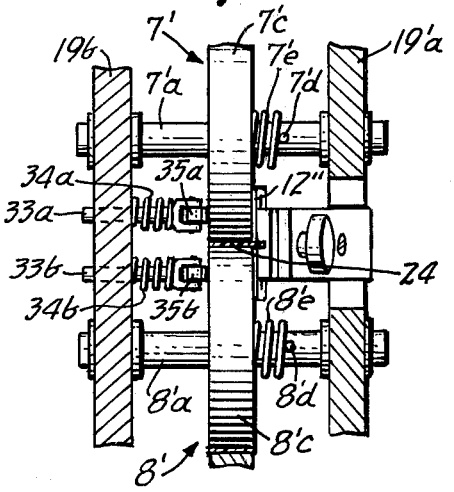
FIG. 6B illustrates a comparable view of an alternate embodiment.

Blade cutting structure 11 and 11' are biased toward one-another by spring mechanism 13 which includes the hook-containing rod 13*a* with the hook-notch 13*aa* retainably hooked over the anchoring key 13*aaa* within the blade cutting structure 11' thereby biased toward blade cutting structure by virtue of spring 13*c* pressing oppositely against head 13*b* and depressor 13*d*, thereby the pressure of cutting edge 12 against lateral side face 8*b* being equal to the pressure of cutting edge 12' against the opposite side face 8'*b*, whereby the free-floating roller 7, against which the blades are also biased, is held centered. In the embodiment of FIG. 6B, both the rollers 7' and 8' are free-floating, and accordingly — in that embodiment as typically illustrated there being solely a cutting edge on one face of the respective rollers — there are provided two separate pressure arms 33*a* and 33*b* with respective rollers 35*a* and 35*b* thereof being biased against their respective rollers by respective springs 34*a* and 34*b*, such allowing for individual wear of either roller on the side faces 7*b* and 8*b* respectively. Accordingly, in that embodiment, the possibly worn surface is nevertheless at all time pressed firmly against the cutting edge 12''. The FIG. 6A illustrates the equally-biased blade cutting edges 12 and 12' respectively. The amount of pressure is variable by the extent to which the head 13*b* is screwed onto the bar 13*a* against the spring 13*c*.

The fixed-position of roller 8 is adjustable as to the spring tension by the extent to which the crank 26 is screwed-down on the shaft 8*a*, against spring 29, prior to locking with lock screw 28, pin 8*c* locking the roller 8 against wedge 8*cc* which is pressed against the support structure 19*a*, the other side support structure being support structure 19*b*.

The flanges 32*a* and 32*b* of the stepped slot-surface 31, guide the tape 24 in to or fro directions 10*b* depending upon whether nut 37*a* is screwed further on or off of shaft 10*a* before locking with locking head 37*b* as the shaft 37*c* is screwed against the end of the shaft 10*a*.

The counter-bias mechanism 17 include a pivot pin 17*a* mount- a lever having handle-end 17*c* and leverage-end 17*b* which moves upwardly between the inwardly biased blade cutting structures 11 and 11' to thereby cause the blade cutting structures 11 and 11' to become spread-apart when the handle-end 17*c* is pressed downwardly in direction 17*d*, causing the cutting edges 12 and 12' to move in directions 18 and 18' respectively.

Depressor 13*d* has a point 13*dd* which is pressibly secured within a slot 11*a* of the blade cutting structure 11.

According the position of the stepped slot determines how much margin extends beyond the side face of the rollers 7 and 8, and as well whether one or the other face of each of those rollers, or whether some is left extending beyond each of opposite side faces which would result in margin being trimmed from both edges of a tape.

The take-up reel 22 is driven by chain (or belt, as desired) 22*a*. The respective reels 22 and 21 are supportedly mounted on support structure 20.

It is within the scope of the invention to make such variations and modifications and substitution of equivalents, as would be apparent to a person of ordinary skill.

I claim:

1. Film trimming device comprising in combination: first and second rollers having spaced-apart substantially parallel axes of rotation and each roller with a radially outward circular circumscribing surface, the radially outward circular circumscribing surfaces of the first and second rollers being in substantial face-to-face contact one-another adapted for drawing a tape therebetween when revolved such that contacting surfaces move in a predetermined first common direction, and each radially outward circular circumscribing surface being shaped and adapted to carry a tape thereon along at least a circumscribing portion when the tape's longitudinal axis follows the circumscribing portion; blade means for trimming margin extending along a longitudinal axis of a tape, including a cutting structure having a cutting edge directed in a direction substantially opposite to said predetermined first common direction and the cutting structure being biased toward lateral side-faces of the first and second rollers, and the first and second rollers having their respective side faces with the cutting edge pressed thereagainst resulting from the cutting structure being biased, in contact with the side faces substantially at a point of said face-to-face contact; and counter-bias means for lifting the cutting structure in a direction counter to the direction of bias for a predetermined distance intermittently whereby tape may be initially fed between the first and second rollers before obviating counter-biasing pressure to allow the blade to slice-into a tape's margin as the cutting edge becomes pressed against a tape edge margin as a tape is continued to be drawn past the cutting edge.

2. A film trimming device of claim 1, including feed-guide means for adjustably positioning of a tape on said circumscribing portion whereby width of margin extending beyond said respective side faces at said point thereby makes the amount of margin to be trimmed adjustable.

3. A film trimming device of claim 2, including first and second shafts one extending along the axis of rotation of one of the first and second rollers and the other extending along the axis of rotation of the other of the first and second rollers, with the respective rollers mounted thereon, at least one of the first and second rollers being free-floating for lateral to and fro movement along the axis of rotation thereof, and further including roller anti-bias means for applying a substantially constant predetermined amount of pressure against an opposite face of the free-floating roller opposite from the side face against which the cutting edge is pressed.

4. A film trimming device of claim 3, including tape-guide structure shaped and positioned to receive tape positioned by the feed-guide means and to thereafter channel the tape to said point and from said point to take-off position, channeling tape along an upper part of the circumscribing portion of one of the first and second rollers and along a lower part of the circumscribing portion of the other of the first and second rollers.

5. A film trimming device of claim 4, in which a remaining one of the first and second rollers is fixed-against lateral to and fro movement along the axis of rotation thereof.

6. A film trimming device of claim 5, including counter-balance means for equating said predetermined amount of pressure with force of the cutting edge pressed against said respective side faces whereby the free-floating roller is maintained with both of said respective side faces in intimate contact with the cutting edge, regulating bias of the blade means and anti-bias of the roller anti-bias means.

7. A film trimming device of claim 6, in which said roller anti-bias means comprises a second cutting structure having a second cutting edge pressing against side faces of both of first and second rollers on faces opposite from the other cutting edge, at said point.

8. A film trimming device of claim 7, including drive means for intermittently causing said first and second rollers to revolve in respective rotational directions such that at said point tape is drawn therebetween in said predetermined direction.

9. A film trimming device of claim 8, in which said counter-balance means comprises adjustable spring structure connected between the cutting structure and the second cutting structure adjustable intermittently of spring-biasing pressure thereof to greater or lesser amounts.

10. A film trimming device of claim 4, including counter-balance means for equating said predetermined amount of pressure with force of the cutting edge pressed against said respective side faces whereby each free-floating roller is maintained with both of said respective side faces in intimate contact with the cutting edge, regulating bias of the blade means and anti-bias of the roller anti-bias means, both the first and second rollers being free-floating for lateral to and fro movement along axes of rotation.

11. A film trimming device of claim 1, including tape-guide structure shape and positioned to receive tape positioned by the feed-guide means and to thereafter channel the tape to said point and from said point to a take-off position, channeling tape along an upper part of the circumscribing portion of one of the first and second rollers and along a lower part of the circumscribing portion of the other of the first and second rollers.

12. A method for trimming an edge margin from a tape, comprising drawing a tape between contacting radially outward circular circumscribing surfaces of opposing first and second rollers, positioning the tape being drawn therebetween, with a predetermined width of a margin thereof positioned beyond corresponding side faces of the first and second rollers, and as tape is being drawn therebetween, positioning a cutting edge directed in a counter-direction to the drawing-direction of the tape and gradually pressing the cutting edge against an outer side of the margin to be trimmed whereby the cutting edge slices into and trims the predetermined width, the cutting edge being thereupon pressed against said corresponding side faces at a point of said drawing.

* * * * *